US010285227B2

(12) United States Patent
Pan et al.

(10) Patent No.: US 10,285,227 B2
(45) Date of Patent: May 7, 2019

(54) PROGRAMMABLE AND ADAPTABLE INTERFACE FOR DIMMING LIGHT EMITTING DIODES

(71) Applicant: AVAGO TECHNOLOGIES INTERNATIONAL SALES PTE. LIMITED

(72) Inventors: Hui Pan, Coto De Caza, CA (US); Jingguang Wang, Aliso Viejo, CA (US); Martin Weetman, Irvine, CA (US)

(73) Assignee: AVAGO TECHNOLOGIES INTERNATIONAL SALES PTE. LIMITED, Singapore (SG)

( * ) Notice: Subject to any disclaimer, the term of this patent is extended or adjusted under 35 U.S.C. 154(b) by 0 days.

(21) Appl. No.: 15/598,682

(22) Filed: May 18, 2017

(65) Prior Publication Data

US 2017/0339762 A1 Nov. 23, 2017

Related U.S. Application Data

(60) Provisional application No. 62/338,198, filed on May 18, 2016.

(51) Int. Cl.
*H05B 37/02* (2006.01)
*H05B 33/08* (2006.01)

(52) U.S. Cl.
CPC ..... *H05B 33/0815* (2013.01); *H05B 33/0845* (2013.01); *H05B 33/0851* (2013.01)

(58) Field of Classification Search
CPC ..... H05B 33/0815; H05B 33/0845; H05B 33/0851
USPC ..... 315/186, 307
See application file for complete search history.

(56) References Cited

U.S. PATENT DOCUMENTS 6,285,306 B1 * 9/2001 Zrilic ..... G06F 7/602 341/143
2007/0170874 A1 * 7/2007 Kunimatsu ..... H05B 33/0809 315/291
2011/0148318 A1 * 6/2011 Shackle ..... H05B 33/0815 315/291
2012/0002974 A1 * 1/2012 Schenk ..... H04B 10/1149 398/130
2012/0326616 A1 * 12/2012 Sumitani ..... H05B 33/0815 315/201
2013/0229215 A1 * 9/2013 Sadwick ..... H03K 3/84 327/164
2013/0320883 A1 * 12/2013 Zheng ..... H05B 33/0815 315/307
2015/0281905 A1 * 10/2015 Breuer ..... H04B 10/116 398/118
2016/0219662 A1 * 7/2016 Ho ..... H05B 33/0848
(Continued)

*Primary Examiner* — Tung X Le
(74) *Attorney, Agent, or Firm* — Xsensus, LLP

(57) ABSTRACT

Described herein is an apparatus including, a decoder that is configured to decode a digital control code. The digital control code corresponds to an intensity level control code of a plurality of LEDs. The apparatus includes a modulator that modulates a combination of the decoded control code and a dither signal, wherein the combined signal has a first modulation format. The apparatus also includes a converter that generates a dimming control signal by converting the first modulation format associated with the combined signal to a programmable second modulation format.

15 Claims, 7 Drawing Sheets

(56) References Cited

U.S. PATENT DOCUMENTS

2017/0263247 A1* 9/2017 Kang ..... G10L 15/20
2017/0280526 A1* 9/2017 Gras ..... H05B 33/0815

* cited by examiner

PROGRAMMABLE AND ADAPTABLE INTERFACE FOR DIMMING LIGHT EMITTING DIODES

CROSS-REFERENCE TO RELATED APPLICATIONS

The present application claims the benefit of the earlier filing date of U.S. provisional application 62/338,198 filed in the United States Patent and Trademark Office on May 18, 2016, the entire contents of which are incorporated herein by reference.

TECHNICAL FIELD

The present disclosure is related to a technique of controlling dimming functionality of light-emitting-diodes.

BACKGROUND

The background description provided herein is for the purpose of generally presenting the context of the disclosure. Work of the presently named inventor(s), to the extent the work is described in this background section, as well as aspects of the description that may not otherwise qualify as prior art, at the time of filing, are neither expressly nor impliedly admitted as prior art against the present disclosure.

Light-emitting-diode (LED) dimming or modulation of LED intensity is typically implemented using modulation schemes that utilize an average duty cycle that is proportional to the desired dimming level in a fixed time-period. For example, modulation schemes such as pulse-width modulation (PWM), and pulse-amplitude modulation (PAM) are commonly utilized to achieve a desired dimming level of the LEDs.

However, PWM suffers from significant ham tonic generation at relatively low frequencies that causes electromagnetic interference (EMI), and is prone to flickering at low LED light intensities. Thus, in order to implement the PWM technique, intense filtering is typically required to remove the high frequency components. Moreover, in order to support high-resolution dimming (e.g., 14 bit dimming), high-resolution digital-to-analog converters (DACs) are required. The high resolution DACs typically occupy a large surface area on a chip and consume substantial amounts of power. Additionally, in implementing PWM/PAM, a high-resolution PWM timer is required to drive the DAC.

Accordingly, there is a requirement for a universal LED dimming interface that can be programmed to provide alternative modulation formats in addition to PWM and DC to overcome the aforementioned problems.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1A:
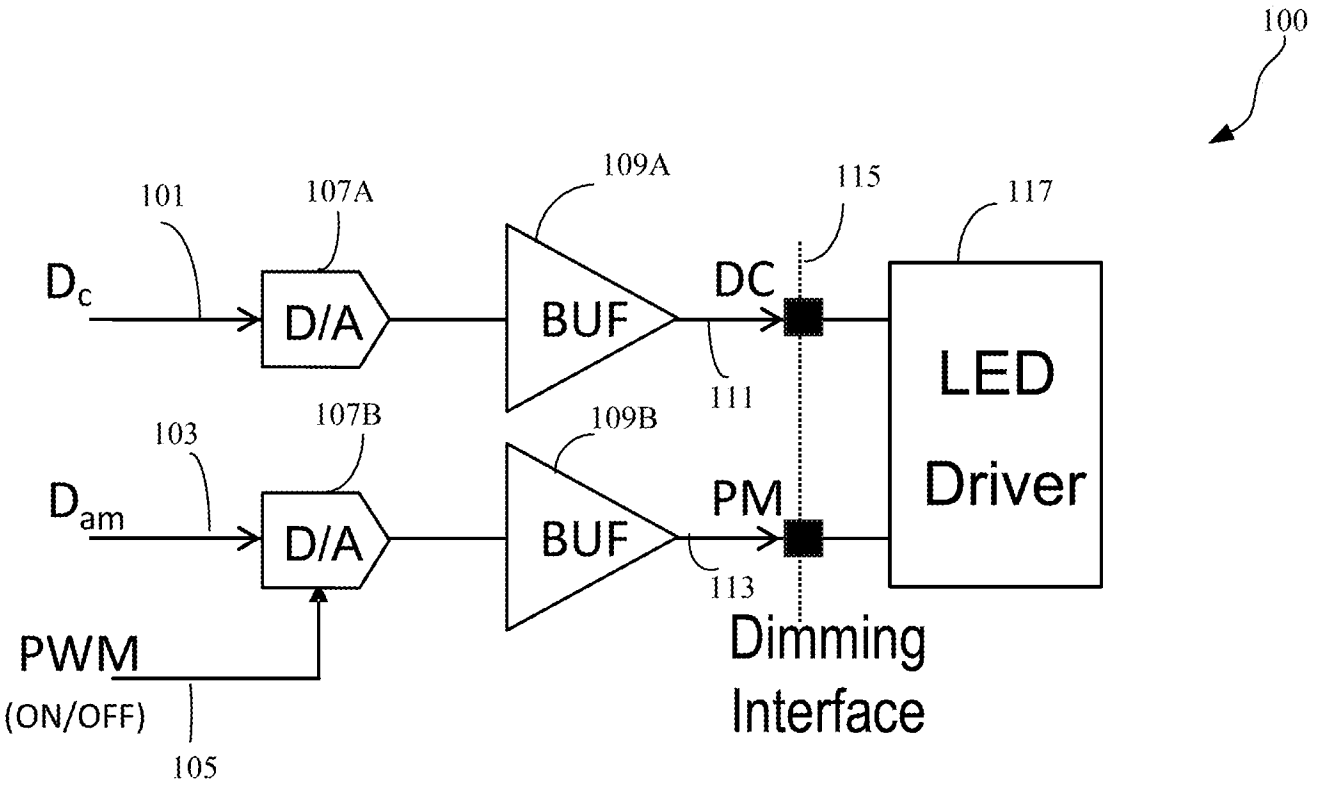
FIG. 1A depicts an exemplary schematic diagram of an interface for LED dimming.

In the drawings, like reference numerals designate identical or corresponding parts throughout the several views. Further, as used herein, the words "a," "an" and the like generally carry a meaning of "one or more," unless stated otherwise.

The detailed description set forth below is intended as a description of various configurations of the subject technology and is not intended to represent the only configurations in which the subject technology can be practiced. The appended drawings arty incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and can be practiced using one or more implementations. In one or more instances, well-known structures and components are shown in block diagram form in order to avoid obscuring the concepts of the subject technology.

An aspect of the present disclosure provides for a device including circuitry configured to determine a first modulation format for a light-emitting-diode (LED) dimming signal. The circuitry receives and decodes an input signal, and further generates the LED dimming signal by converting a second modulation format corresponding to the decoded input signal to the first modulation format.

By one aspect of the present disclosure, there is provided a method for generating a light-emitting-diode (LED) dimming signal. The method includes the steps of determining by circuitry, a first modulation format for the LED dimming signal. Further, the method receives and decodes an input signal, wherein the input signal is an N-bit digital signal. Further, the method includes the step of generating by the circuitry, the LED dimming signal by converting a second modulation format corresponding to the decoded input signal to the first modulation format.

By another aspect of the present disclosure, there is provided an apparatus comprising a decoder configured to decode a digital control code. The apparatus includes a modulator configured to modulate a combination of the decoded control code and a dither signal. The combined signal has a first modulation format. Further, the apparatus includes a converter configured to generate a dimming signal by converting the first modulation format associated with the combined signal to a second modulation format.

Turning to FIG. 1A, there is depicted an exemplary schematic diagram of an interface 100 for LED dimming control Specifically, the interface 100 as depicted in FIG. 1A is a PWM/PAM (or PM) plus DC interface for controlling LED dimming.

As shown in FIG. 1A, a pair of digital input signals 101 and 103 is input to a pair of high-resolution digital-to-analog converters (DACs) 107A and 107B, respectively. The input signal 101 corresponds to a digital control signal ($D_c$), whereas the input signals 103 and 105 correspond, respectively, to a digital amplitude modulation signal ($D_{am}$) and a pulse width modulation (PWM) signal turning DAC 107B output on and off.

The input signal 101 is processed by the DAC 107A and converted into an analog signal that is input to a buffer 109A. The output of the buffer 109A is a direct current (DC) signal 111 that is input to a dimming interface 115, which is connected to a LED driver 117. The amplitude modulation signal 103 is input to the DAC 107B, which is driven by an on/off control signal (e.g., a timing signal) 105. The control signal 105 may be a PWM timing signal that controls a duty cycle of the pulse width modulation signal. The DAC 107B converts the input digital signal to an analog signal, and transmits the analog signal to the buffer 109B. In this manner, a PWM or PAM signal that serves as a dimming signal (PM) 113 is output to the dimming interface 115. Accordingly, by one embodiment, the interface 100 generates both, a DC signal (111) and a PWM or PAM signal (113) that is used by the LED driver 117 to control dimming of the LEDs. The buffers 109A and 109B are respectively used to change a current/voltage level of the output signal based on a load that is attached to the driver 117. The LED driver 117 converts line voltage power to a power level that, low voltage LEDs can utilize.

By one embodiment, the dimming interface 115 can include one or more components that generate a dimming control level from input power. For example, if the input power is AC power and the dimming control level is a voltage (e.g., DC power), then the dimming interface 115 can include one or more power converters. In doing so, the dimming interface 115 is enabled to receive input power of 120 V, and generate a dimming control level with a range, for example, between of 0 VDC and 10 VDC. As another example, when the dimming control level is a current, the dimming interface 115 can receive input power of 120 VAC and generate a dimming control level with a range between of 0 A and 1 A.

In order to support high-resolution dimming, the interface 100 utilizes high-resolution digital-to-analog converters (DACs) and a precision timer that operates at high frequencies (e.g. PWM timer 105). The high resolution DACs typically occupy a large surface area on a chip, and consume substantial amounts of power. The high-resolution PWM timer 105 may require high operational frequency, and use multi-phase clocks. Further, the PWM dimming may be executed at a fixed frequency, and thus may be prone to EMI and flicker issues in the LED interface.

Figure 1B:
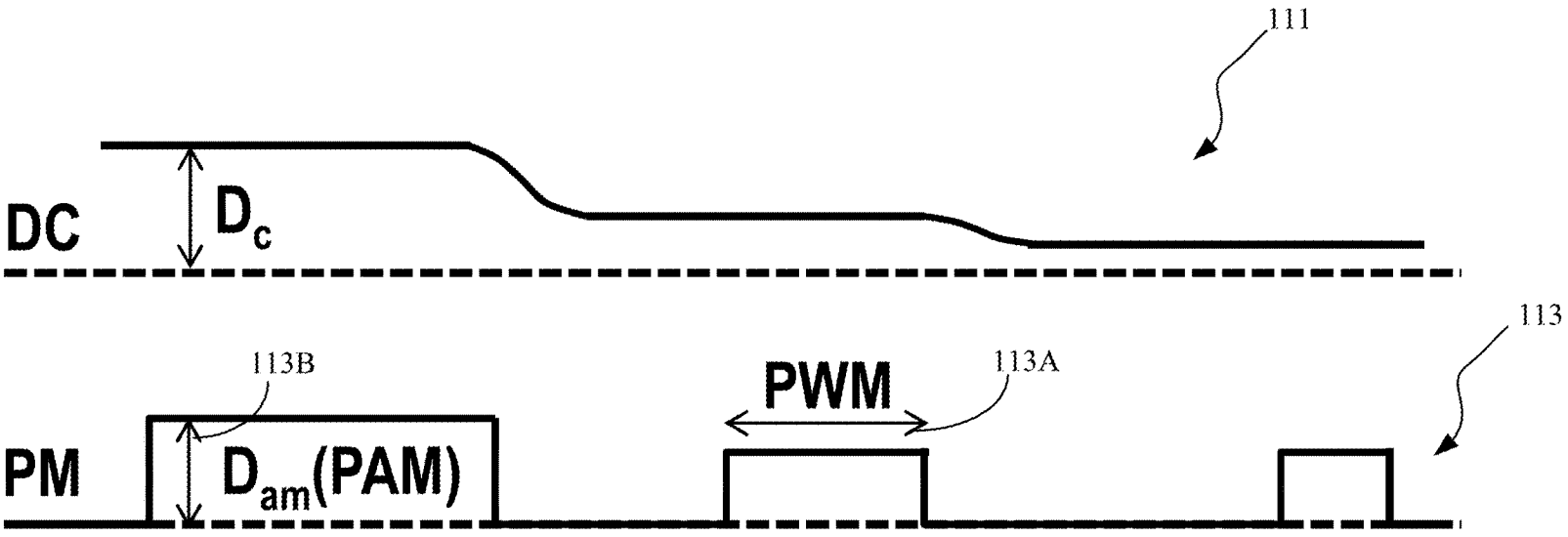
FIG. 1B is an exemplary graph of output signals obtained at the interface of FIG. 1A.

FIG. 1B depicts an exemplary graph of the output signals from the interface 100 of FIG. 1A. As stated previously and shown in FIG. 1B, the LED dimming interface 100 includes both, a DC signal 111, and a pulse modulated (PM) signal (i.e., either a PWM signal and/or a PAM signal) 113. The DC signal 111 can vary the intensity of the LEDs by controlling the level ($D_c$) of the DC signal. Moreover, the intensity of the LEDs can be controlled by varying a width of the PWM pulses 113A and/or an amplitude ($D_{am}$ (PAM)) 113B of the pulses.

Figure 2:
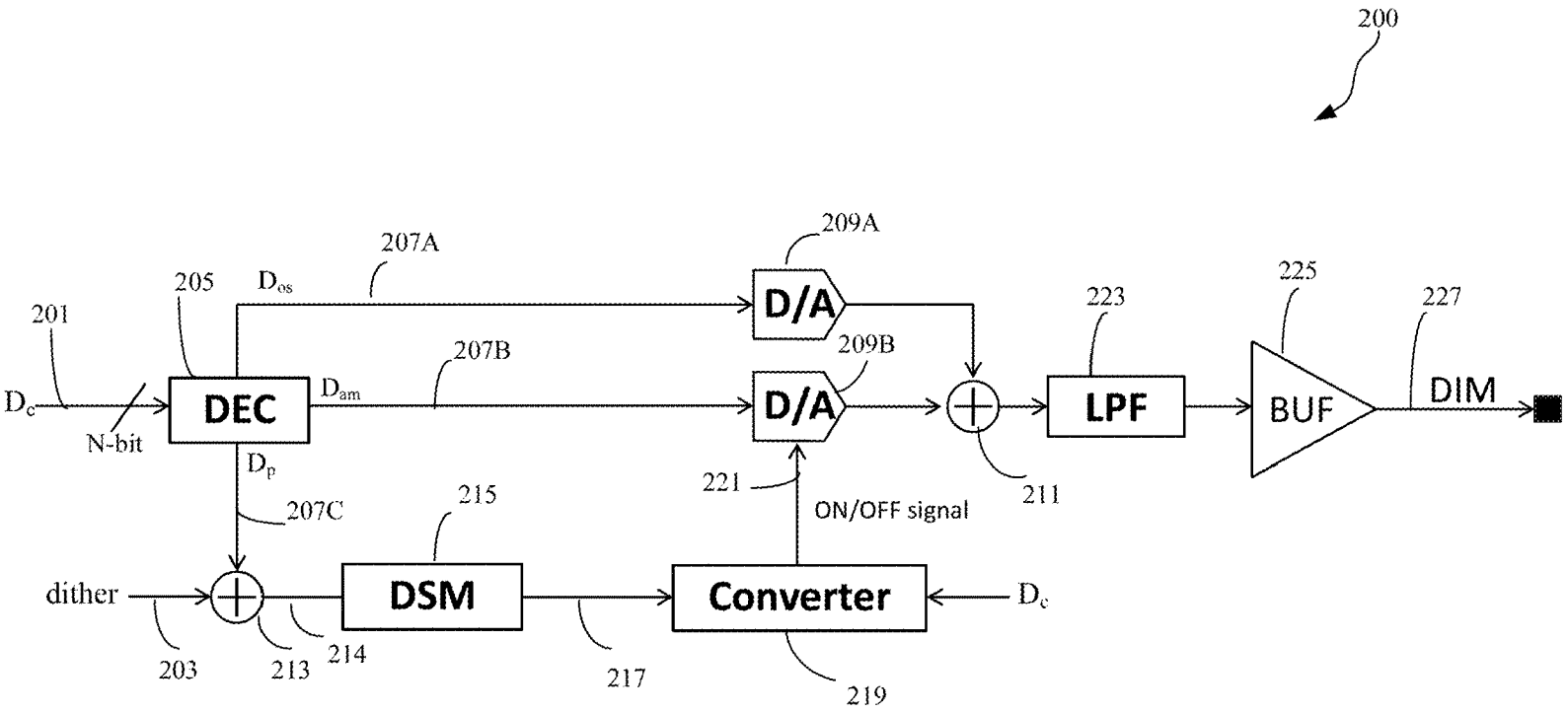
FIG. 2 depicts according to an embodiment, an exemplary LED dimming interface.

Turning now to FIG. 2, there is illustrated according to an embodiment, exemplary LED dimming interface 200. As shown in FIG. 2, a digital control code ($D_c$) 201 is input into a decoder 205. By one embodiment, the digital control code 201 is an 'n-bit' code (e.g., 14-bit code) corresponding to an LED light intensity level. The decoder 205 maps the input digital code 201 to three digital signals that control the waveform which is output at the interface: an offset signal (Dos) 207A, an amplitude control signal ($D_{am}$) 207B, and a pulse control signal ($D_p$) 207C. The offset signal 207A and the amplitude control signal 207B are input to DACs 209A and 209B, respectively. The DACs 209A and 209B convert the input digital signals to respective output analog signals that are summed (i.e., added) by the adder 211.

By one embodiment, a dither signal 203 is added to the pulse signal 207C by the adder 213 to form a dithered-pulse signal 214. Note that a dither signal is a random signal in the form of a noise signal that is used to randomize quantization error.

Further, the dithered-pulse signal 214 is input to a delta-sigma-modulator (DSM) 215 to output a delta-sigma-modulated signal 217. The delta-sigma modulated signal 217 is input to a converter 219. By one embodiment, the converter can be a counter (described later with reference to FIG. 4) that is configured to change the modulation format of an input signal. For instance, the converter 219 may be configured to change the modulation format of the input signal (i.e., delta-sigma modulation) to one of a plurality of different modulation formats such as PWM, PDM, PAM etc., where PDM stands for pulse density modulation. The modulation altered data stream 221 is used to drive the DAC 209B.

By one embodiment, the delta sigma modulator 215 converts a DC input signal to a pulse modulated (DSM) signal using noise shaping for high resolution at a limited oversampling ratio (OSR) without the need for a very fast clock to provide the timing resolution required by the PWM timer. Moreover as stated previously, the modulator also utilizes dithering for better EMI performance. Further, in order to make the interface 200 adaptable with respect to the input LED control code, by one embodiment, the input LED intensity level control code 201 is input into the converter 219. In this manner, the over-sampling ratio parameter of the delta-sigma modulator, as well as the PDM pulse width parameter can be controlled with respect to the LED light intensity level.

Further, the output of the adder 211 is passed through a low pass filter 223. The output of the low pass filter 223 is input to a buffer 225, whereafter the LED dimming signal 227 is passed to the LED driver. The buffer 225 can be configured to change a current/voltage level of the output signal (DIM) 227 based on a load that is attached to the driver.

Accordingly, as shown in FIG. 2, the LED dimming interface 200 is a programmable and adaptable interface that is configured to generate a dimming signal to control an intensity of light output by the LEDs in multiple signal formats. For instance, the interface 200 decodes a LED dimming control signal ($D_c$) to generate a dimming, signal (DIM) in one of a plurality of modulation formats that include direct current (DC), pulse width modulation (PWM), pulse amplitude modulation (PAM), delta sigma modulation (DSM), pulse density modulation (PDM), and various combinations of signal formats such as any pulse modulation (PM) plus arbitrary DC signal.

The architecture of the interface 200 as shown in FIG. 2 incurs the advantageous ability of configuring the LED dimming interface 200 to improve LED dimming performance with respect to EMI, flicker, power, cost, or the like, by modifying the format of the dimming signal output from the LED dimming interface as well as other associated signal characteristics such as amplitude, frequency, etc. Moreover, the dimming interface does not require high precision DAC and a high-precision PWM timer as required by the dimming interface of FIG. 1A. Rather, precision (i.e., accuracy) in the low frequency band is achieved by utilizing a high-order delta-sigma modulator. Moreover, by one embodiment, the modulation format for the dimming signal is determined based on specific application requirements. For instance, in applications that require low flickering and/or low EMI, a DC signal may be chosen as the dimming signal to drive the LED driver. In contrast, in applications which require high power efficiency, a pulse modulation such as PAM, PWD, PDM or a combination thereof may be chosen to drive the LED driver.

Figure 3:
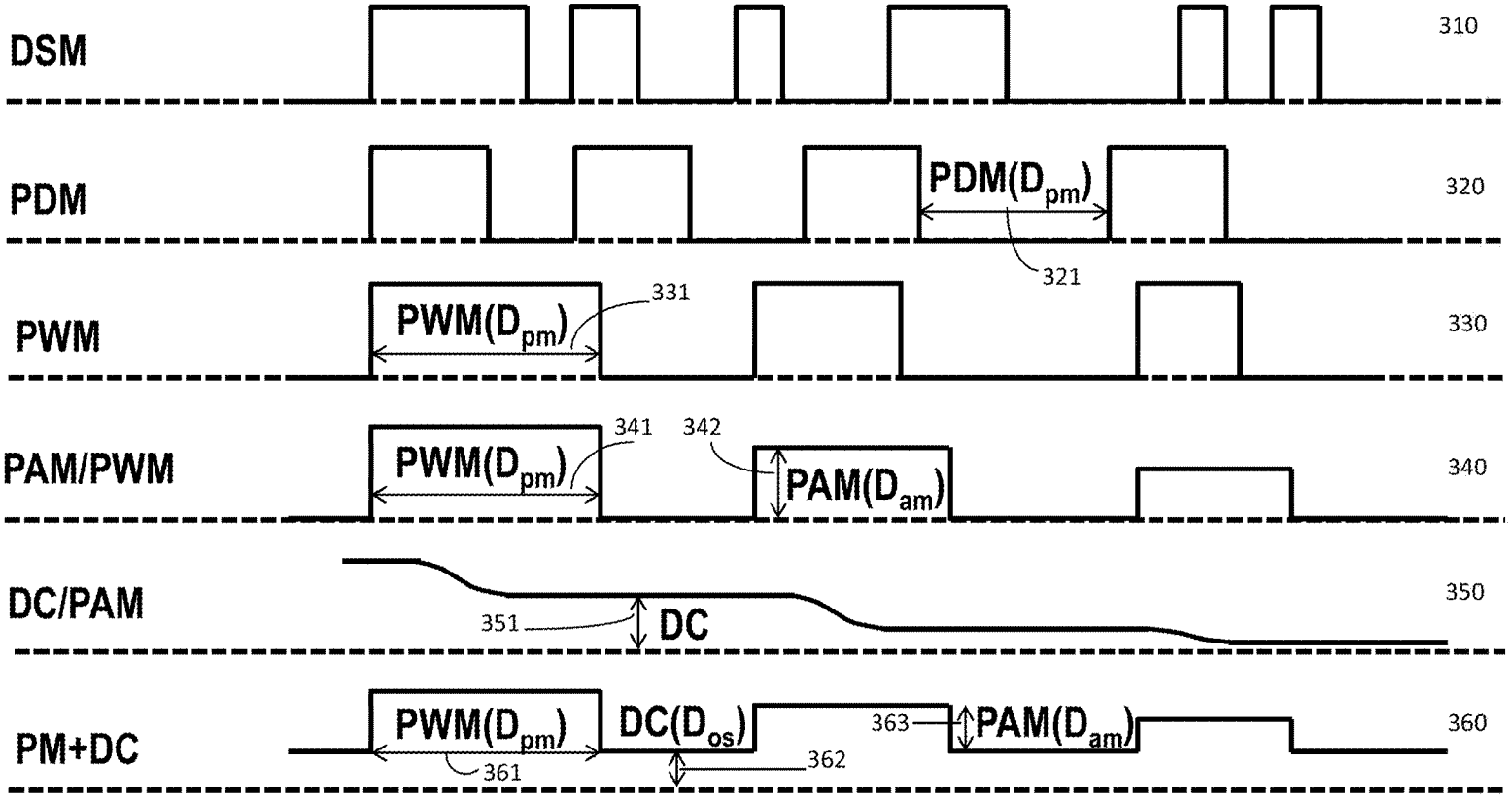
FIG. 3 is an exemplary graph of output signals obtained from the interface of FIG. 2.

FIG. 3 depicts an exemplary graph of output signals obtained from the interface of FIG. 2. Specifically, FIG. 3 depicts a plurality of output signals that can be obtained at the output 227 of the interface 200.

As shown in FIG. 3, a delta-sigma modulated (DSM) signal 310 can be obtained at the output of the interface 200. The DSM signal 310 includes pulses that have a random width and are spaced in a random manner. In other words, the spacing between the pulses of the DSM signal 310 is random.

The signal 320 of FIG. 3 is a pulse-density modulated signal, wherein the pulses have a fixed or programmable width while spacing 321 between the pulses is modulated and varies with LED light intensity. Further, signal 330 corresponds to a pulse-width-modulated (PWM) signal, wherein the width of each pulse 331 is modulated and varies with LED light intensity, while the inter-pulse spacing is constant. As shown in FIG. 3, signal 340 corresponds to a pulse-amplitude modulated (PAM)/pulse-width modulated (PWM) signal, wherein the width of the pulse 311 and/or amplitude of the pulse 342 can be modulated to modify an intensity of the LEDs.

Further, signal 350 corresponds to a direct current (DC) signal, wherein the signal level 351 can be regulated in order to control air intensity of the LEDs. Signal 360 corresponds to a combination of a pulse modulated (PM) signal and a direct current (DC) signal. As shown in FIG. 3, in the PM+DC signal 360, one can modify a width of the pulse 361, an amplitude of the pulse 363, and/or an offset of the pulse 362 in order to control an intensity of the LEDs.

According to one embodiment, the signals PDM, PWM, PAM can he generated by the converter 219 (FIG. 2). As stated previously, the converter, by one embodiment, may include a counter that is configured to perform a modulation format conversion in order to drive the LED interface by a desired driving signal. In what follows, is described an exemplary technique of performing modulation format conversion by one aspect of the present disclosure.

Figure 4:
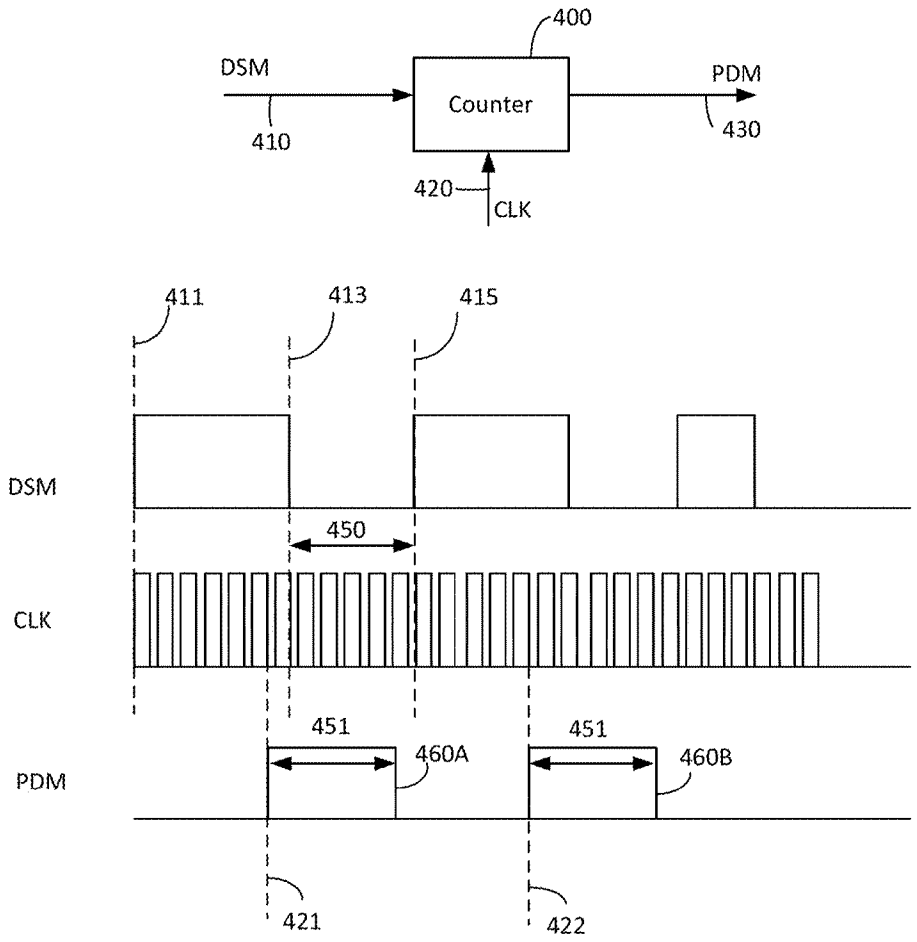
FIG. 4 depicts an exemplary modulation format conversion process.

As shown in FIG. 4, a counter 400 receives as input, a DSM signal 410. Referring to FIG. 2, note that the DSM signal is the output of the delta-sigma-modulator 215. The DSM signal 410 is a signal having a random pulse-width, and a random spacing between the pulses. The counter 400 is driven by a clock signal 420 of a predetermined frequency. By one embodiment, the counter 400 is configured to generate a PDM signal, which is characterized as a signal that has a fixed pulse width, and a variable spacing between the pulses.

By one embodiment, the counter 400 is activated at each rising edge (e.g., edges denoted as 411 and 415) of a DSM pulse, and de-activated at the falling edge 413 of the DSM pulse. In other words, the counter 400 is programmed to start counting the number of clock pulses starting at a time-instant corresponding to a rising edge of the DSM pulse 411, and stop counting the clock pulses at a time instant corresponding to the falling edge of the DSM pulse. Further, the counter 400 is programmed to be in a de-activated state for a time period corresponding to a time interval 450 between consecutive pulses of the DSM signal.

By one embodiment, the counter 400 may be configured to generate a pulse upon the counting a predetermined number of clock pulses. For instance, as shown in FIG. 4, the counter 400 may be configured to generate a pulse 460A (of a fixed width 451) upon counting six clock pulses. The generation of the fixed width pulse 460A occurs at a time instant 421 that corresponds to a time when the counter has counted six clock pulses. Upon counting six clock pulses the counter 400 may be reset to commence the counting of subsequent clock pulses. By one embodiment, the width 451 of the generated pulse 460A corresponds to the width of six clock pulses. In this manner, by selecting the number of clock pulses to be counted, the width of the generated pulses can be programmed. As shown in FIG. 4, the counter is activated at a time instant 415 (second rising edge of the DSM pulse) to resume the counting process. Further, when the count of the counter reaches six clock pulses, a second pulse 460B is generated that has the same width as that of the pulse 460A. In this manner, the counter is configured to change the modulation format of an incoming signal (e.g., DSM) to a PDM signal.

Figure 5:
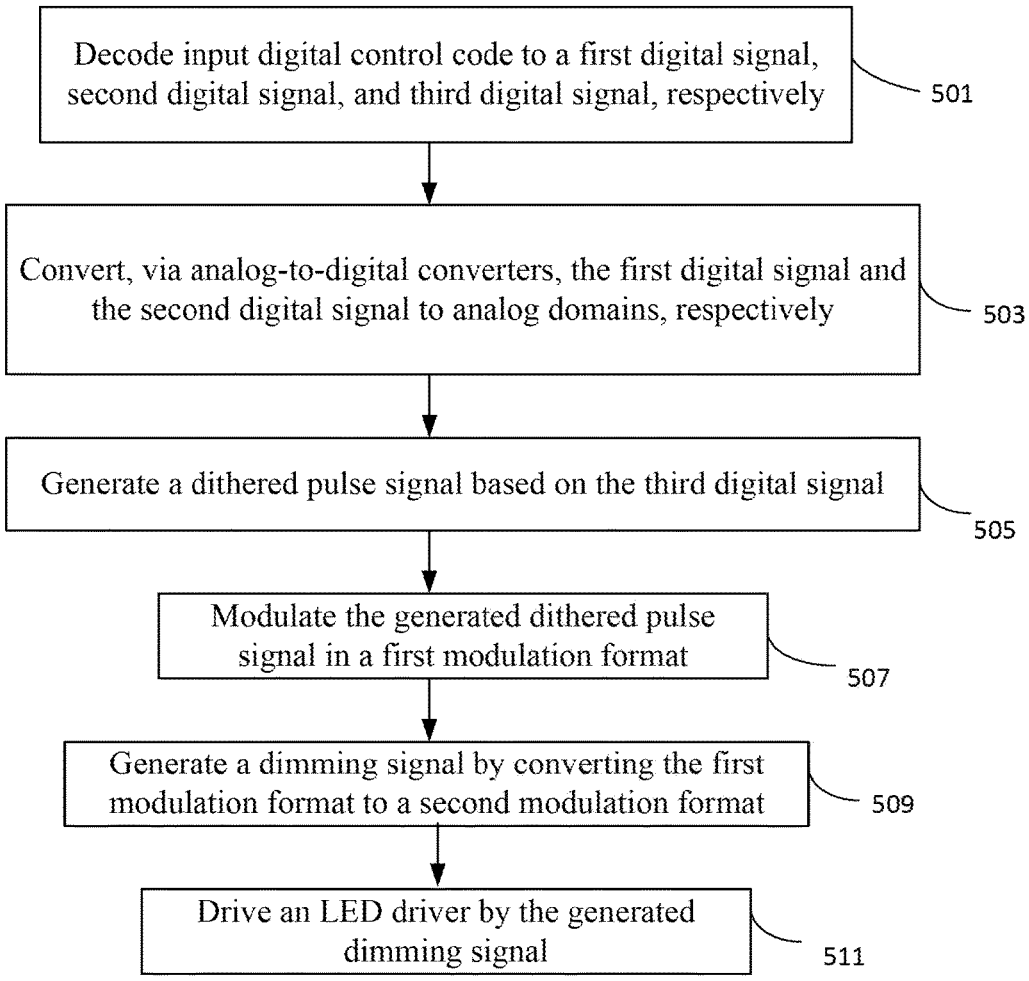
FIG. 5 illustrates an exemplary flowchart depicting the steps performed in generating a dimming control signal.

Turning to FIG. 5, there is depicted according to an embodiment of the present disclosure, a flowchart depicting the steps performed, for instance by a microcontroller, (described later with reference to FIG. 6) in generating a dimming signal to control a dimming functionality of a plurality of LEDs.

The process begins in step 501, wherein an input digital control code corresponding to an LED intensity level control code is decoded by a decoder. By one embodiment, the decoder maps the input digital control code into three digital signals: a first signal corresponding to an offset signal, a second signal corresponding to an amplitude control signal, and a third signal corresponding to a pulse control signal.

In step 503, the first signal and the second signal are converted to analog signals respectively, via dedicated digital-to-analog converters (e.g., converters 209A and 209B, as shown in FIG. 2).

In step 505, a dithered pulse signal is generated based on the third digital signal (i.e., the pulse digital control signal). For example, as stated previously with respect to FIG. 2, a dither signal is added to the pulse control signal to form a dithered-pulse control signal. Note that a dither signal is a random signal in the form of a noise signal that is used to randomize quantization error.

Further, in step 507, the generated dithered pulse signal is modulated in a first modulation format. By one embodiment, a delta-sigma modulator is utilized to modulate the dithered pulse control signal to generate, a delta sigma modulation format.

The process proceeds to step 509, wherein the modulation format of the dithered pulse control signal is converted from a first modulation format (e.g., delta-sigma modulation) to a second modulation format. For instance, a counter can be utilized to convert the delta-sigma modulation format to one of a PWM, PDM, PAM modulation formats. As shown in FIG. 2, the modulation format converted signal modulates (i.e. turns on or off) the output of the analog-to-digital converter associated with the second digital signal (i.e., the amplitude control signal).

By one embodiment, the signals output from the digital-to-analog-converters associated with the first digital signal and the second digital signals, respectively, are combined and processed by a low pass filter, which converts the pulse modulation (PM) signal from the low-resolution digital-to-analog converter to a high-precision DC signal. The pulse modulation signal appears at the low pass filter output when the low pass filter is bypassed or the low pass filter bandwidth is ideally programmed to infinity. In step 511, a dimming control signal i.e., output of the low pass filter is used to drive an LED driver that controls a dimming of LEDs. It must be appreciated that the dimming signal may be a DC signal (i.e., a signal obtained via low pass filtering of the pulse modulation signal) or a pulse modulation PWM, DSM, PAM, or PDM signal respectively that is obtained via a modulation conversion. Further, note that the dimming signal may be a combination of the DC signal and a pulse modulated signal, respectively.

By one embodiment, each of the functions of the described embodiments may be implemented by one or more processing circuits. A processing circuit includes a programmed processor (for example, a microprocessor 610 in FIG. 6), as a processor includes circuitry. A processing circuit may also include devices such as an application-specific integrated circuit (ASIC) and circuit components that are arranged to perform the recited functions.

Figure 6:
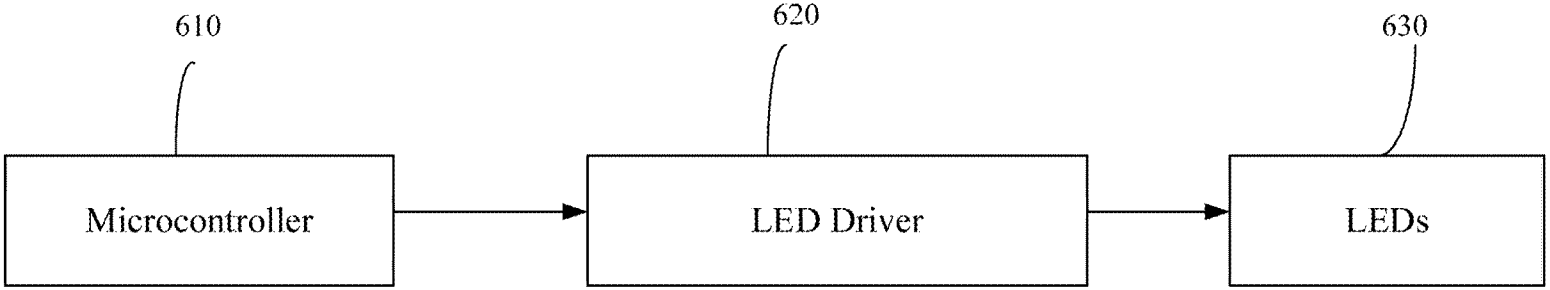
FIG. 6 depicts an exemplary schematic illustration of controlling a dimming functionality of a plurality of LEDs.

The various features discussed above may be implemented by a the microprocessor 610, that is configured to generate the dimming signal to control an intensity of the LEDs. As shown in FIG. 6, the microcontroller generates the dimming signal to drive the LED driver 620. The LED driver 620 controls the lighting and dimming functionality of a plurality of LEDs that are coupled to the driver.

By one embodiment, the microcontroller 610 may also include special purpose logic devices (e.g., application specific integrated circuits (ASICs)) or configurable logic devices (e.g., simple programmable logic devices (SPLDs), complex programmable logic devices (CPLDs), and field programmable gate arrays (FPGAs)).

The microcontroller 610 may be configured to execute one or more sequences of one or more instructions contained in a memory (included in the microcontroller) one or more processors in a multi-processing arrangement may also be employed to execute the sequences of instructions contained in the memory. In alternative embodiments, hard-wired circuitry may be used in place of or in combination with software instructions. Thus, embodiments are not limited to any specific combination of hardware circuitry and software.

While aspects of the present disclosure have been described in conjunction with the specific embodiments thereof that are proposed as examples, alternatives, modifications, and variations to the examples may be made. It should be noted that, as used in the specification and the appended claims, the singular forms "a," "an", and "the" include plural referents unless the context clearly dictates otherwise.

A number of implementations have been described. Nevertheless, it will be understood that various modifications may be made without departing from the spirit and scope of this disclosure. For example, preferable results may be achieved if the steps of the disclosed techniques were performed in a different sequence, if components in the disclosed systems were combined in a different manner, or if the components were replaced or supplemented by other components. Additionally, implementation may be performed on modules or hardware not identical to those described. Accordingly, other implementations are within the scope that may be claimed.

The invention claimed is:

1. A device comprising:

circuitry configured to receive and decode an input signal, the decoded input signal having a first modulation format, generate a light emitting diode (LED) dimming signal by converting the first modulation format to a second modulation format, add a dither signal to the decoded input signal to form a dithered input signal;

modulate the dithered input signal to have the first modulation format, and over-sample the dithered input signal at an over-sampling ratio that is programmable with respect to the input signal, the input signal being a digital signal corresponding to an intensity level of an LED.

2. The device of claim 1, wherein the second modulation format is one of a delta sigma modulation, a pulse width modulation, a pulse amplitude modulation, a direct current modulation, and a pulse density modulation.

3. The device of claim 1, wherein the first modulation for at is delta-sigma modulation.

4. The device of claim 1, wherein the first modulation format is identical to the second modulation format.

5. The device of claim 1, wherein the circuitry is configured to covert the first modulation format to the second modulation format based on a counter.

6. A method for generating a light-emitting-diode (LED) dimming signal, the method comprising:

receiving and decoding an input signal, the input signal being an N-bit digital signal, and the decoded input signal having a first modulation format;

generating by the circuitry, the LED dimming signal by converting the first modulation format to a second modulation format;

adding a dither signal to the decoded input signal to form a dithered input signal;

modulating by the circuitry the dithered input signal to have the first modulation format; and over-sampling the dithered input signal at an over-sampling ratio that is programmable with respect to the input signal, the input signal corresponding to an intensity level of an LED.

7. The method of claim 6, wherein the second modulation format is one of a delta sigma modulation, a pulse width modulation, a pulse amplitude modulation, a direct current modulation, and a pulse density modulation.

8. The method of claim 6, wherein the first modulation format is delta-sigma modulation.

9. The method of claim 6, further comprising:

converting via a counter, the first modulation format to the second modulation format.

10. An apparatus comprising:

a decoder configured to decode a digital control code;

a modulator configured to modulate a combination of the decoded control code and a dither signal, the combined signal having a first modulation format; and a converter configured to generate a dimming signal by converting the first modulation format associated with the combined signal to a second modulation format, wherein the dither signal is over-sampled at an over-sampling ratio that is programmable with respect to the digital control code, the digital control code corresponding to an intensity level of a plurality of LEDs.

11. The apparatus of claim 10, wherein the first modulation format associated with the combined signal is a delta-sigma modulation, and the second modulation format associated with the dimming signal is one of a delta sigma modulation, a pulse width modulation, a pulse amplitude modulation, and a pulse density modulation.

12. The apparatus of claim 10, wherein the modulator is a delta-sigma modulator, and the converter is a counter.

13. The apparatus of claim 10, further comprising:

a low-pass filter configured to convert a pulse-modulated signal to a high-precision DC signal without using a high-resolution DAC.

14. The apparatus of claim 10, wherein the dither signal is a random-noise signal.

15. The apparatus of claim 10, further comprising:

a buffer configured to scale a magnitude of the generated dimming signal based on a plurality of LEDs.

* * * * *